United States Patent [19]

Siskin et al.

[11] 3,957,628

[45] May 18, 1976

[54] REMOVAL OF ORGANIC SULFUR COMPOUNDS FROM HYDROCARBON FEEDSTOCKS

[75] Inventors: Michael Siskin, Maplewood; Joseph J. Porcelli, Scotch Plains, both of N.J.

[73] Assignee: Exxon Research and Engineering Company, Linden, N.J.

[22] Filed: Dec. 30, 1974

[21] Appl. No.: 537,068

[52] U.S. Cl. ..... 208/223; 208/254 H

[51] Int. Cl.[2] ..... C10G 17/04

[58] Field of Search ..... 208/209, 223, 254, 280, 208/241

[56] References Cited

UNITED STATES PATENTS

| | | | |
|---|---|---|---|
| 2,366,743 | 1/1945 | Matuszak | 208/280 |
| 2,689,207 | 9/1954 | Gerald | 208/241 |
| 3,036,968 | 5/1962 | Gatsis | 208/254 |
| 3,123,550 | 3/1964 | Skomoroski et al. | 208/223 |

*Primary Examiner*—Delbert E. Gantz
*Assistant Examiner*—G. J. Crasanakis
*Attorney, Agent, or Firm*—John W. Ditsler

[57] ABSTRACT

A process in which organic sulfur, nitrogen and oxygen compounds are essentially quantitatively removed from hydrocarbon feedstocks by contacting said feedstocks with liquid hydrogen fluoride in the presence of hydrogen. Preferred feedstocks are those boiling in the range of from about −185°C to about 345°C wherein the sulfur content ranges from about 0.001 to about 10 wt. %, preferably 0.001 to about 3 wt. %.

17 Claims, No Drawings

REMOVAL OF ORGANIC SULFUR COMPOUNDS FROM HYDROCARBON FEEDSTOCKS

FIELD OF THE INVENTION

The present invention relates to a process for refining sulfur, oxygen and nitrogen contaminated hydrocarbon feedstocks. Particularly, the invention concerns a process wherein organic sulfur compounds are virtually quantitatively extracted from said feedstocks by contacting, in the presence of hydrogen, said feedstocks with hydrogen fluoride at least a portion of which is in the liquid phase. More particularly, this invention relates to the removal of organic sulfur compounds from feeds containing same and boiling between about −185°C and about 345°C.

DESCRIPTION OF THE PRIOR ART

It has long been recognized that the presence of impurities such as sulfur, metals, nitrogen, oxygen, resins, and the like in hydrocarbon feedstocks tend to poison or deactivate acidic catalysts which comprise a refractory oxide, a noble metal, and a Lewis acid and/or a Bronsted acid component. Such catalysts may be used in reactions such as reforming, alkylation, isomerization and the like. To overcome this problem, it has been proposed that such impurities, particularly organic sulfur compounds, may be removed from hydrocarbon fractions by extraction with a suitable solvent. The solvent may be in either the liquid or vapor phase and may include hydrogen fluoride, boron trifluoride, sulfur dioxide and others alone or in combination (see, for example, British Pat. No. 292,932, U.S. Pat. Nos. 2,343,841; 2,440,258; 2,450,588; 2,465,964; 2,519,587; 2,564,071; and 2,643,971). In addition, U.S. Pat. No. 2,689,207 describes a combination process involving extraction of sulfur from hydrocarbon fractions with hydrogen fluoride followed by a separate hydrogenation step wherein sulfur in the extracted fraction is converted to hydrogen sulfide which is then removed, leaving a sulfur-free hydrogen fluoride hydrocarbon liquid which is recycled to the extraction stage for further contacting with the original hydrocarbon fractions. U.S. Pat. No. 3,123,550 discloses a process for removing nitrogen from distillates by a process comprising hydrotreating a mixture of the distillate and a mineral acid (such as a hydrogen halide) over a supported hydrogenation catalyst. However, none of the foregoing prior art teaches a one-step process for desulfurizing and/or extracting organic sulfur compounds from a hydrocarbon feedstock using hydrogen fluoride in the liquid phase in the absence of a specific hydrogenation catalyst and in the presence of hydrogen.

SUMMARY OF THE INVENTION

It has now been found that a hydrocarbon feedstock may be refined to effect the virtual quantitative removal of organic sulfur, oxygen and nitrogen compounds by contacting said feedstock in a reaction zone and in the presence of hydrogen, with hydrogen fluoride, at least a portion of which is in the liquid phase. This invention is particularly applicable to desulfurizing sulfur-containing hydrocarbon feedstocks. Temperatures are not critical to the practice of the present invention and may range broadly so long as at least a portion of the hydrogen fluoride can be maintained in the liquid phase. Thus, the only limiting features insofar as temperature is concerned are the melting point and the critical temperature of hydrogen fluoride. The only limitation on pressure is that the hydrogen partial pressure be sufficient to maintain at least a portion of the hydrogen fluoride in the liquid phase.

Thus, when a hydrocarbon feedstock is contacted in a reaction zone with liquid hydrogen fluoride under the conditions previously set forth, there results a substantially sulfur-free, oxygen-free and nitrogen-free (the description of the invention being hereinafter illustrated with reference to sulfur-containing feedstocks) hydrocarbon that may be in the gas and/or liquid phase, a sulfur-containing hydrogen fluoride liquid phase and a gas phase comprising hydrogen and hydrogen fluoride. Substantially sulfur-free hydrogen fluoride may then be recovered from the hydrogen fluoride liquid phase while the substantially sulfur-free hydrocarbon may be sent to additional refinery processing. In a preferred embodiment of this invention, at least a portion of the substantially sulfur-free hydrogen fluoride thus recovered is recycled to the reaction zone for reuse indefinitely with only the addition of make-up quantities of hydrogen fluoride being required from time to time.

DETAILED DESCRIPTION OF THE INVENTION

In general, the extraction reaction occurs in the liquid phase. The hydrocarbon feedstock, however, may be in either vapor phase, liquid phase or mixed phase. If said hydrocarbon feedstock is a liquid, the products from the reaction zone will comprise two liquid phases and a gas phase comprising hydrogen and hydrogen fluoride. The liquid phases will comprise a substantially sulfur-free hydrocarbon raffinate and a sulfur-containing hydrogen fluoride extract. Hydrogen sulfide may be evolved when some organic compounds react in the hydrogen fluoride liquid in the presence of hydrogen. The hydrogen sulfide so formed will be predominantly in the gas phase and may be, to some extent, present in the two liquid phases. If the hydrocarbon feedstock is gaseous, the products from the reaction zone will comprise a sulfur-containing hydrogen fluoride liquid phase and a gas phase comprising hydrogen fluoride, hydrogen and substantially sulfur-free hydrocarbon. If the hydrocarbon feedstock is in mixed phase, the products from the reaction zone will comprise two liquid phases as above and a gas phase comprising substantially sulfur-free hydrocarbon, hydrogen and hydrogen fluoride. Hydrogen sulfide may also be evolved and present in the liquid phase(s) and gas phase as previously mentioned.

While not wishing to be bound by any particular theory, we believe that the extraction process proceeds in a manner such that the hydrogen fluoride and organic sulfur compound combine in a type of sulfur forming neutralization reaction wherein the more acidic hydrogen fluoride donates a proton to the more basic sulfur atom via the non-bonding electrons in the organic sulfur compound. Thus, the present invention may be applied to feedstocks containing aliphatic (including straight chained, branched and cyclic saturated and unsaturated compounds singly or in combination) as well as substituted and unsubstituted aromatic organic compounds. In the case of organic sulfur compounds, this may include for example sulfides, mercaptans, disulfides and thiophenes. However, other organic groups such as oxygen and nitrogen may be present in the hydrocarbon feedstock and in the organic compound. Because the nitrogen and oxygen atoms in these compounds provide a center which is a Lewis base for interaction with hydrogen fluoride, they will be extracted along with the organic sulfur compounds into the liquid hydrogen fluoride phase. Thus, the process of the present invention may be applied to organic compounds selected from the group consisting of sulfur, oxygen and nitrogen or mixtures thereof. Examples of organic oxygen compounds that might be present in the hydrocarbon feedstock are naphthenic acids, phenols, furans, benzofurans, dibenzofurans and amides. Examples of suitable organic nitrogen compounds that might be present in said feedstock are pyridines, quinolines, pyrroles, indoles, carbazoles, benzcarbazoles and acridanes.

Thus, the process of the present invention may be applied to any hydrocarbon feedstock in either gas or liquid phase including crude oils, light hydrocarbons ($C_1$-$C_{10}$), atmospheric distillates (e.g., naphthas, gasolines, kerosenes, diesel oils, gas oils, lubricating oils or mixtures thereof), and residua which are derived from petroleum, coal, shale oil kerogen, tar sands bitumen or mixtures thereof. In view of the manner in which applicants believe the reaction proceeds, one skilled in the art will readily recognize that the product yield will vary with feed sulfur content and the molecular weight of the sulfur compound therein. This is true when the entire sulfur bearing molecule is removed from the feedstock rather than sulfur alone. The loss in yield, therefore, could be substantial since, for example, a sulfur bearing molecule in a gasoline fraction will contain roughly, three times as much hydrocarbon as there is sulfur on a weight basis. This means that a gasoline fraction containing 1 wt. % of sulfur experiences a loss of about 3 wt. % when the sulfur is removed by extraction. As the molecular weight of the fraction increases, the proportionate loss becomes greater, in that the sulfur contained in the molecule represents a lower percentage of the total weight of the molecule. Thus, the present invention will be more economically attractive and hence favor the treatment of hydrocarbon feedstocks containing lower molecular weight sulfur compounds. Preferred feedstocks, therefore, include distillates such as naphthas, gasolines, kerosenes, diesel oils and gas oils. This invention, however, may be applied advantageously to heavier feedstocks such as residua which contain higher molecular weight sulfur compounds.

Generally, a substantial portion of the distillates, that is, more than 10 volume %, preferably more than 50 volume %, more preferably more than 70%, most preferably more than 90 volume %, will boil at temperatures less than about 345°C. Preferably these distillates will boil in the temperature range of from about 25°C to about 270°C and will include naphthas, kerosenes, gasolines, diesel oils and light gas oils. Most preferably, the distillates will boil in the range of from about 50°C to about 205°C and include naphthas, kerosenes and gasolines.

As noted above, the process of the present invention can suitably treat any hydrocarbon feedstock containing any amount of sulfur. In general, however, the process of the present invention can treat hydrocarbon feedstocks containing from about 0.001 to about 10 wt. % sulfur, preferably from about 0.001 to about 7 wt. % sulfur, more preferably from about 0.001 to about 5 wt. % sulfur, and most preferably from about 0.001 to about 3 wt. % sulfur. The preferred feedstocks may be characterized by having sulfur contents of from about 0.004 to about 0.2 wt. % for naphthas, from about 0.0025 to about 1.0 wt. % for kerosenes, from about 0.001 to about 0.5 wt. % for gasolines, and from about 0.02 to about 3.0 wt. % for gas oils. While distillates having lower molecular weight sulfur compounds are preferred, it may be advantageous to process a residua derived from a low sulfur crude that would contain a relatively low level of sulfur.

The hydrocarbon feedstock may also be characterized by having both nitrogen and oxygen contents of at least 1 wppm, but less than about 3000 wppm, preferably less than about 1500 wppm, more preferably less than 700 wppm, and most preferably less than about 300 wppm, based on hydrocarbon feed. Specifically the nitrogen content may vary from about 5 to about 100 wppm for naphthas and gasolines, from about 25 to about 250 wppm for kerosenes, and from about 100 to about 1300 wppm for gas oils. Similarly, the oxygen contents of the preferred feedstocks may vary from about 1 to about 25 wppm for naphthas and gasolines, from about 10 to about 100 for kerosenes, and about 100 to about 1300 for gas oils. Clearly then, the process of the present invention is broadly applicable to a wide variety of feedstocks.

In the process of the present invention, substantially anhydrous liquid hydrogen fluoride is employed as the extraction solvent. This is because substantial quantities of water present in the system cause the formation of a hydrogen fluoride-water azeotrope, thereby making it increasingly difficult to recover the hydrogen fluoride and favoring a more corrosive environment. Accordingly, it is preferred to effect the extraction process under substantially anhydrous conditions. However, the inclusion of relatively small amounts of water can be tolerated to the extent that the hydrogen fluoride/water azeotrope is minimized in conjunction with the economics of the process, i.e., until the amount of hydrogen fluoride lost due to the hydrogen fluoride/water azeotrope becomes uneconomical. In practice, while substantially anhydrous hydrogen fluoride is preferred, the hydrogen fluoride may contain up to about 10 wt. % of water, preferably no more than about 5 wt. % of water.

The amount of liquid hydrogen fluoride solvent employed is not critical and depends upon the amount of organic sulfur compound to be removed as well as the hydrocarbon oil to be treated. In general, the amount of solvent may be expressed as the weight ratio of liquid hydrogen fluoride to hydrocarbon feed, and may range from about 0.0005 to about 0.5, preferably from about 0.001 to about 0.4, more preferably from about 0.01 to about 0.3, most preferably from about 0.1 to about 0.2.

The amount of hydrogen present in the reaction zone is also not critical to the practice of the present invention provided a sufficient amount is present to maintain at least a portion of the hydrogen fluoride in the liquid phase. The hydrogen serves as a direct or indirect source to supply or replenish the hydrogen required during the hydrodesulfurization reaction to form hydrogen sulfide and evolved hydrocarbons. The hydrogen may be present in the form of a hydrogen-containing gas which may be obtained from any number of sources including commercially available pure hydrogen, naphtha reformers, hydrogen plants, as well as the off gases from any hydrotreating process or hydrogen donor organic molecules such as tetralin, methylcyclohexane and the like. The term hydrotreating process is meant to include hydrofining, hydrocracking, hydrodesulfurization and the like or synthetic schemes in which hydrogen is a product. The hydrogen-containing gas may be pure or contain other gaseous materials such as light hydrocarbons ($C_1$-$C_{10}$), carbon monoxide, carbon dioxide, hydrogen sulfide and the like. The hydrogen-containing gas may be introduced into the reaction zone alone or be mixed with the hydrocarbon feed prior to introduction into the reaction zone. Preferably the hydrogen-containing gas will be dry.

It is essential that the extraction reaction be conducted at a temperature below the critical temperature of hydrogen fluoride. The particular temperature employed may range from about the melting point of hydrogen fluoride to +188°C., the critical temperature of hydrogen fluoride.

There appears to be some variance in the literature regarding the melting point of hydrogen fluoride. For example, it is shown as −83.1°C in the "Handbook of Chemistry and Physics", 54th edition edited by R. C. Weast, Chemical Rubber Company Press, Cleveland, Ohio, 1973. The 31st edition (1949) of the same reference edited by Charles D. Hodgman lists the melting point as −92.3°C. Nevertheless, the lower end of the temperature range is limited by the melting point of hydrogen fluoride regardless of differences noted in the literature.

Preferably, the temperature will range from about −60°C to about +120°C, most preferably from about −30°C to about +70°C. When contacting normally gaseous hydrocarbon feedstocks containing olefinic hydrocarbons containing three or more carbon atoms and paraffinic hydrocarbons containing four or more carbon atoms, it may be desired, depending upon the subsequent process in which the product will be used, to maintain temperatures below about 27°C to avoid alkylation reactions.

The pressure at which the process is carried out is not critical to effecting the extraction and will depend upon the nature of the feedstream being processed, the temperature at which the reaction is being carried out as well as other variables. In general, the pressure should be sufficient to maintain a portion of the hydrogen fluoride in the liquid phase. This may be expressed in terms of hydrogen partial pressure which may range from about 1 to about 100 atm., preferably from about 1 to about 50 atm., and most preferably from about 1 to about 35 atm. Generally, higher hydrogen partial pressures may be preferred for higher boiling feedstocks; e.g. gas oils and residua, to increase the degree of hydrodesulfurization. The process may be operated under a total pressure ranging from about 1 to 150 atm.

The reaction occurs rather promptly and the contact time required need only be that sufficient to effect a substantial removal of organic sulfur compounds from the hydrocarbon feedstock. Thus, the contact time may vary from a few minutes to several hours depending on the temperature, extraction efficiency and other interrelated variables. Generally, the contact time will vary from 1 second to about 5 hours, preferably from 1 second to about 2 hours, more preferably from 1 second to about 1 hours, and most preferably from about 1 second to about 30 minutes.

The hydrocarbon feedstock may be contacted with liquid hydrogen fluoride and hydrogen in any suitable apparatus. Contacting may be effected in batch, multiple batch, semi-continuous, or continuous operation. For example, it may be carried out in continuous (differential) contacting equipment such as simple gravity operated extractors with no mechanical agitator, mechanically agitated extractors, centrifugal extractors, or packed or unpacked towers with or without mixing orifices. Preferably, a high efficiency multistage countercurrent extractor will be used. Equipment most suitable for a specific application can be selected by one skilled in the art from available equipment as described in, but not limited to, Sections 18 and 21 of the Fourth Edition of the "Chemical Engineers' Handbook" edited by John H. Perry (1963). The contacting equipment does not require the use of any special materials of construction, i.e., carbon steel is quite satisfactory. However, alloy materials such as monel, aluminum 5052 and the like, as well as teflon, may be used if the system contains sufficient quantities of water.

After a suitable contacting period, the product from the reaction zone may be readily separated by a variety of methods depending upon the extraction system used. If the hydrocarbon feedstock is in the liquid phase, the product from the reaction zone may be separated into a substantially sulfur-free hydrocarbon raffinate, a sulfur-containing hydrogen fluoride extract and a gas phase comprising hydrogen and hydrogen fluoride. The substantially sulfur-free hydrocarbon raffinate contains predominantly substantially sulfur-free hydrocarbon, but may also contain any unextracted organic sulfur compounds, the amount of which is dependent upon the efficiency of the extraction. In addition, dissolved gases such as hydrogen sulfide, hydrogen and evolved hydrocarbons may also be present in the raffinate, the amount of each being dependent upon the equilibrium between corresponding components in the gas phase. The hydrogen sulfide and evolved hydrocarbons are formed in the reaction zone when some organic compounds react in the hydrogen fluoride liquid in the presence of hydrogen. Hydrogen fluoride may also be present in the substantially sulfur-free hydrocarbon raffinate. In a similar manner, the sulfur-containing hydrogen fluoride extract contains predominantly hydrogen fluoride but may also contain extracted organic sulfur compounds. Hydrogen, hydrogen sulfide, evolved hydrocarbons and hydrocarbon feedstock may also be present in the extract. If the hydrocarbon feedstock is in the gas phase, the products from the reaction zone may be separated into a sulfur-containing hydrogen fluoride liquid phase and a gas phase comprising hydrogen, hydrogen fluoride and substantially sulfur-free hydrocarbon. The sulfur-containing hydrogen fluoride liquid phase and the gas phase will contain the same components set forth above except that the gas phase includes substantially sulfur-free hydrocarbon. If at least a portion of the hydrocarbon feedstock is in the gas phase, the products may be separated into a sulfur-containing hydrogen fluoride liquid phase, a substantially sulfur-free liquid hydrocarbon phase and a gas phase comprising hydrogen, hydrogen fluoride and substantially sulfur-free hydrocarbon. Separation of the product from the reaction zone may be done in any convenient manner such settling, decanting, heating and the like.

In general, the gas phase will comprise predominantly hydrogen and hydrogen fluoride but may also contain hydrogen sulfide, evolved hydrocarbons, residual organic sulfur compounds not removed during the extraction and other gaseous components present in the hydrogen-containing gas. In addition, substantially that portion of the hydrocarbon feedstock entering the reaction zone as a vapor will be present in the gas phase. The relative amount of hydrogen fluoride present in the gas phase is dependent upon the partial pressure at the temperature and pressure of the reaction zone.

When at least a portion of the hydrocarbon is a liquid, the substantially sulfur-free hydrocarbon raffinate may contain small amounts of hydrogen fluoride which are dissolved or dispersed therein. The removal of said hydrogen fluoride from the raffinate may be accomplished by heating and stripping of the hydrogen fluoride, which may be recycled, or by neutralization. A stripping aid such as an inert gas, e.g., CO, $CO_2$, $H_2$, $N_2$, $C_1$-$C_6$ or reactor tail gases may be used. Similarly, any hydrogen sulfide present in the hydrocarbon liquid may be removed by heating or neutralization. If the hydrocarbon or a portion thereof is a gas, the hydrogen sulfide may be removed therefrom by any number of known methods (see, for example, U.S. Pat. Nos. 3,709,976; 3,709,983 and 3,716,620), as may the hydrogen fluoride and, if desired, the hydrocarbons formed during the extraction reaction, thereby yielding a hydrocarbon product substantially free from organic sulfur compounds.

The hydrocarbon product thus recovered comprises hydrocarbon feed from which substantially all of the organic sulfur compounds have been removed. This corresponds to a product which contains less than 0.01(1/100) wt. % sulfur, preferably less than 0.005 wt. %, more preferably less than 0.003 wt. %, and most preferably less than 0.001 wt. % sulfur. The sulfur-free hydrocarbon is then available for further refinery processing particularly those that employ catalyst systems that are sensitive to sulfur compounds.

The hydrogen fluoride liquid phase contains organic sulfur compounds removed from the hydrocarbon feedstock, any other compounds that may react (e.g. compounds involving metals, oxygen, notrogen, etc.) if such compounds were present in the feedstock, as well as hydrogen sulfide formed during the contacting. Recovery of hydrogen fluoride from the sulfur-containing hydrogen fluoride liquid and the concomitant removal of any hydrogen sulfide may be done by heating, since hydrogen fluoride is volatile at slightly elevated temperatures, e.g., 20°C, thereby leaving a liquid containing the extracted sulfur compounds along with any other extracted materials. The heating step may be accomplished by simple distillation. At least a portion of the hydrogen fluoride thus recovered from the various product streams may then be recycled to the reaction zone to treat fresh hydrocarbon feedstock.

The following examples are shown to illustrate but not unduly limit the scope of the process of this invention:

EXAMPLE 1

An unhydrofined light virgin naphtha feedstock having an end point of 82°C was passed continuously at a rate of 30 cc/hr through a vessel containing 71g of liquid hydrogen fluoride at room temperature and under 150 psig of hydrogen pressure. The untreated feed contained 23 wppm of sulfur. There was no agitation of the hydrogen fluoride wash liquid other than the 0.5 cc/min flow of feed. The product was analyzed periodically as set forth in the table below:

TABLE I

| Time (hrs) | Sulfur (WPPM) |
|---|---|
| 22.4 | |
| 70 | |
| 100.8 | |
| 117 | |
| 140 | <1 |
| 165 | |
| 194 | |
| 240 | |
| 288 | |
| 350 | |

The sulfur analysis was carried out using an F&M 720 gas chromatograph with a 2m × 6mm Triton X305 on Chromosorb P column coupled with a microcoulometer. It is clear that the product, after more than two weeks, is essentially sulfur free.

EXAMPLE 2

The procedure of Example 1 was repeated with the same feed, this time spiked to the 200 wppm level with representative sulfur compounds and the flow rate was increased to 60 cc/hr. The results are set forth below:

TABLE II

| Time (hrs) | Sulfur (WPPM) |
|---|---|
| 12 | 13 |
| 60 | 22 |
| 85 | 18 |
| 162 | 42 |
| 180 | 31 |
| 279 | 20 |

At hour 279 the flow rate was decreased to 30 cc/hr.

| | |
|---|---|
| 983 | 10 |
| 984 | 9 |
| 986 | 8 |

From this example, it is clear that after a single extraction step, the sulfur level is substantially reduced. A second extraction step of the hydrocarbon feedstream, such as would occur in a multistage operation, would reduce the level of sulfur to < 1 wppm as observed in Example 1. A commercial multistage countercurrent extractor would also operate at much higher efficiency. After the run in Example 2 was terminated, 99.2 wt. % of the hydrogen fluoride was recovered by simple fractionation distillation from the sulfur components.

While two specific examples of the invention have been described in detail, it should be understood that the invention is not limited to the specific system or conditions therein described since many alternative arrangements and operating conditions will be readily apparent from the above description to one skilled in the art.

What is claimed is:

1. A process for the removal of sulfur compounds from a hydrocarbon feedstock which comprises contacting said feedstock in a reaction zone with hydrogen and with hydrogen fluoride, at least a portion of the hydrogen fluoride being in the liquid phase at a temperature above the melting point of hydrogen fluoride and below the critical temperature of said hydrogen fluoride, and separating a hydrocarbon substantially free of sulfur compounds from said hydrogen fluoride.

2. The process of claim 1 wherein the hydrocarbon feedstock contains from about 0.001 to about 10 wt. % sulfur.

3. The process of claim 2 wherein the hydrogen partial pressure ranges from about 1 to about 100 atmospheres.

4. The process of claim 2 wherein the weight ratio of hydrogen fluoride to hydrocarbon feedstock ranges from about 0.0005 to about 0.5.

5. The process of claim 4 wherein the hydrocarbon feedstock boils in the range of from about −185° to about 345°C.

6. The process of claim 5 wherein the substantially sulfur-free hydrocarbon contains less than 0.01 wt. % sulfur.

7. The process of claim 6 wherein the hydrogen fluoride from which said hydrocarbon was separated is recovered and at least a portion thereof is recycled to said reaction zone.

8. A process for the removal of sulfur compounds from a hydrocarbon feedstock, wherein more than 50 volume % of said hydrocarbon boils at a temperature less than 345°C, which comprises contacting said feedstock in a reaction zone with hydrogen and with hydrogen fluoride at a temperature ranging from about the melting point of hydrogen fluoride to about 188°C and at a hydrogen partial pressure ranging from about 1 to about 50 atmospheres for a time sufficient to effect a substantial removal of organic sulfur compounds and separating a hydrocarbon substantially free of sulfur compounds from said hydrogen fluoride.

9. The process of claim 8 wherein the hydrocarbon feedstock boils in a range of from about 25° to about 270°C.

10. The process of claim 8 wherein the weight ratio of hydrogen fluoride to hydrocarbon feedstock ranges from about 0.01 to about 0.3.

11. The process of claim 10 wherein the hydrocarbon feedstock contains from about 0.001 to about 5 wt. % sulfur.

12. The process of claim 11 wherein the hydrogen fluoride from which said hydrocarbon was separated is recovered and at least a portion thereof recycled to said reaction zone.

13. A process for removal of sulfur compounds from a hydrocarbon feedstock, wherein more than 90% of said feedstock boils at a temperature less than about 345°C and has a sulfur content ranging from about 0.001 to about 3.0 wt. %, which comprises contacting said feedstock in a reaction zone with hydrogen and with substantially anhydrous hydrogen fluoride at a temperature ranging from about −30° to about +70°C at hydrogen partial pressure of from about 1 to about 35 atmospheres for a time sufficient to effect a substantially complete removal of organic sulfur compounds from said hydrocarbon feedstock, the mixture from said reaction zone comprising a substantially sulfur-free hydrocarbon product, a sulfur-containing hydrogen fluoride liquid, and a gas containing hydrogen sulfide, at least a portion of said hydrogen fluoride liquid being recycled to said reaction zone.

14. The process of claim 13 wherein said hydrocarbon feedstock is a distillate selected from the group consisting of naphtha, kerosene and gasoline derived from petroleum, coal, shale oil kerogen, tar sands bitumen or mixtures thereof.

15. The process of claim 13 wherein said hydrocarbon feedstock boils at a temperature ranging from about 50° to about 205°C.

16. The process of claim 15 wherein the weight ratio of hydrogen fluoride to hydrocarbon feedstock ranges from about 0.1 to about 0.2.

17. The process of claim 16 wherein said sulfur-free hydrocarbon contains less than 0.001 wt. % sulfur.

* * * * *